US011591856B2

(12) United States Patent
Youngquist, Jr. et al.

(10) Patent No.: US 11,591,856 B2
(45) Date of Patent: Feb. 28, 2023

(54) DRILLABLE CENTERING GUIDES USED TO DRILL A LARGE DIAMETER WATER WELL

(71) Applicant: Youngquist Brothers, LLC, Myers, FL (US)

(72) Inventors: Harvey Bruce Youngquist, Jr., Fort Myers, FL (US); Brett Alan Youngquist, Fort Myers, FL (US)

(73) Assignee: Youngquist Brothers, LLC, Fort Myers, FL (US)

( * ) Notice: Subject to any disclaimer, the term of this patent is extended or adjusted under 35 U.S.C. 154(b) by 95 days.

(21) Appl. No.: 17/146,908

(22) Filed: Jan. 12, 2021

(65) Prior Publication Data

US 2021/0215002 A1 Jul. 15, 2021

Related U.S. Application Data

(60) Provisional application No. 62/961,352, filed on Jan. 15, 2020.

(51) Int. Cl.
*E21B 7/28* (2006.01)
*E21B 15/00* (2006.01)
(Continued)

(52) U.S. Cl.
CPC ..... *E21B 7/28* (2013.01); *E21B 15/00* (2013.01); *E21B 19/14* (2013.01); *E21B 34/02* (2013.01); *E21B 2200/05* (2020.05)

(58) Field of Classification Search
CPC . E21B 7/28; E21B 15/00; E21B 19/14; E21B 34/02; E21B 2200/05
See application file for complete search history.

(56) References Cited

U.S. PATENT DOCUMENTS 4,655,286 A * 4/1987 Wood ..... E21B 33/127 166/185
4,825,944 A * 5/1989 Mays ..... E21B 43/10 166/158
2004/0065475 A1* 4/2004 Laursen ..... E21B 7/128 175/7

FOREIGN PATENT DOCUMENTS

WO WO-2016032698 A1 * 3/2016 ..... G01V 5/145

* cited by examiner

*Primary Examiner* — D. Andrews
*Assistant Examiner* — Ronald R Runyan
(74) *Attorney, Agent, or Firm* — Brandon T. Cook; Gunn, Lee & Cave, P.C.

(57) ABSTRACT

A large diameter injection water well is drilled using a drilling derrick and rotary drilling techniques. After snubbing in and drilling a short distance with drilling mud, a temporary drilling header is installed below the blowout preventers. Extending downward from the temporary drilling header is a drop pipe with a valve on the lower end thereof. Drilling pipe with attachments on the lower end thereof, are lowered into the drop pipe with the valve closed. After sealing to the drilling pipe, the valve is opened and the drilling pipe and attachments are lowered to the bottom of the well for the normal drilling operation. Thereafter, the drilling pipe and attachments are removed reversing the process of retracting into the drop pipe and closing the valve before removing the seal from the drilling pipe. The repeated insertion of the drilling pipe with various attachments on the end thereof in the drilling procedure occurs without having to kill or suppress the well until the final step when removing the drop pipe. Large diameter drillable centering guides insures pilot holes are being drilled in the bottom center of the large diameter injection water well.

8 Claims, 7 Drawing Sheets

(51) Int. Cl.
*E21B 34/02* (2006.01)
*E21B 19/14* (2006.01)

FIG.7
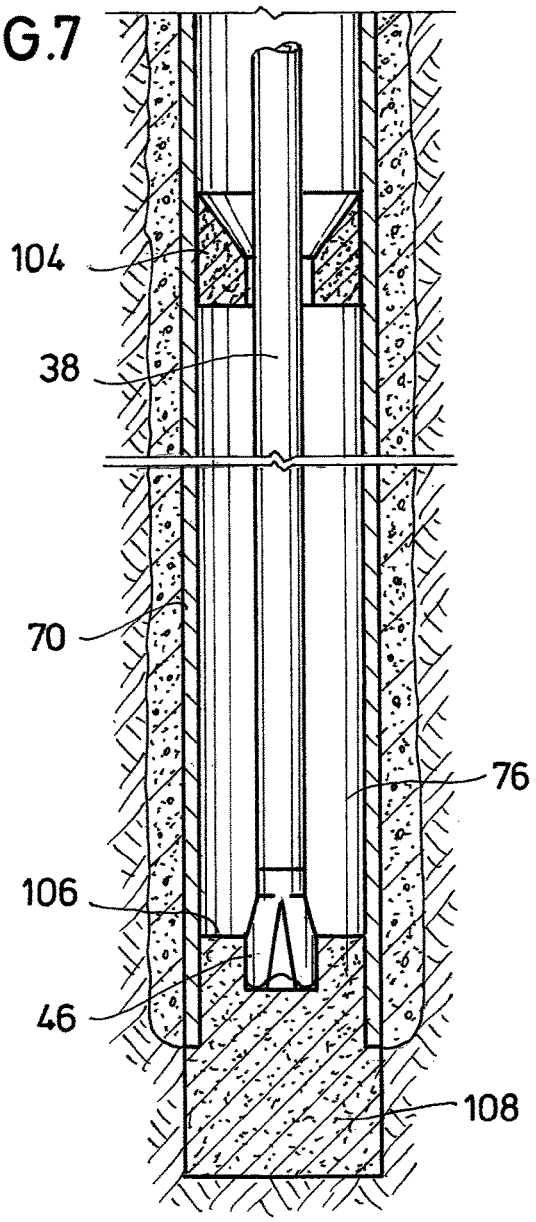
FIG.8
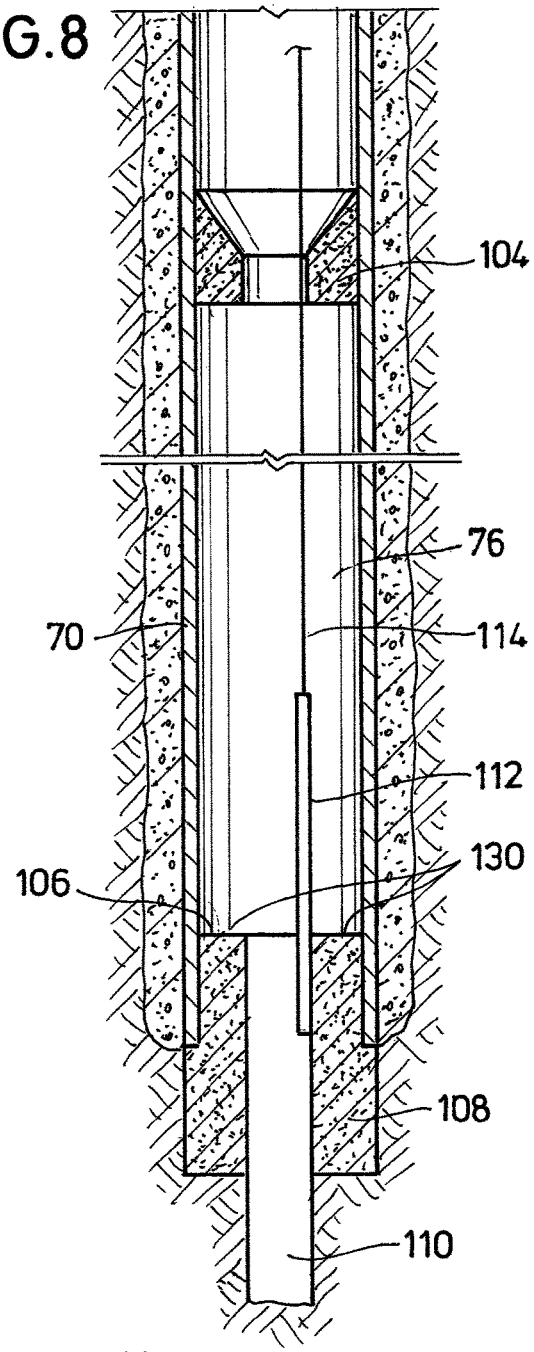
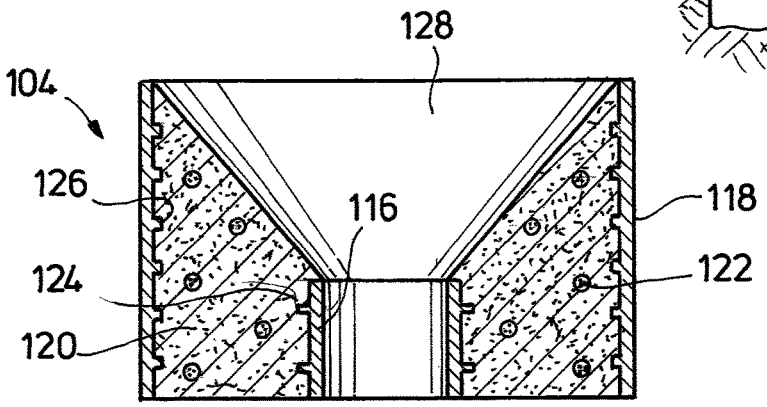
FIG.9

DRILLABLE CENTERING GUIDES USED TO DRILL A LARGE DIAMETER WATER WELL

CROSS-REFERENCE TO RELATED PATENTS

This is (1.) an improvement over patent application Ser. No. 15/987,409 filed on May 23, 2018 which issued on Dec. 3, 2019 as U.S. Pat. No. 10,494,896, (2.) a formal utility patent application claiming priority to Provisional Patent Application No. 62/961,523 filed on Jan. 15, 2020, and (3) a formal utility patent application claiming priority of Provisional Patent Application No. 62/961,532, filed on Jan. 15, 2020, all which are incorporated herein by reference.

BACKGROUND OF INVENTION

Field of the Invention

This invention relates generally to the use of drillable guides in drilling of a large diameter injection well, and also to the control of artesian flow without the use of weighted well drilling material such as salt or barite.

Description of the Prior Art

Perforations in the earth's surface to find and release hydrocarbons is well known. Typically an oil well is created by a drilling hole into the earth with a drilling rig that rotates a drill string with a bit attached to the lower end. As the hole is drilled to an ascribed depth, sections of steel casing are set in a hole. The casing is slightly smaller in diameter than the borehole. The casing provides structural integrity to the newly drilled wellbore and isolates zones from each other and from the surface. As the well is drilled deeper, smaller casing and smaller bits are used.

Generally, the same type of equipment used in drilling an oil and/or gas well can be used in drilling injection wells from the surface. In the state of Florida, injection wells have been used for disposal of both storm water and municipal waste water for many years. In Florida, disposal of municipal waste water, including treated waste water, is injected deep underground into highly permeable rock formations that naturally contain saline water. The geological formation that most commonly receives the injected water is the lower most portion of the Floridian Aquifer System, which is between the depths of approximately 2,500 to 3,400 feet below the land surface. The formation at this depth is made up of limestone and dolostone which contain highly transmissive solution channels. This zone is commonly referred to as the "Boulder Zone".

The Boulder Zone has highly brackish water with a salinity that is similar to seawater. Separating the brackish water from the fresh water contained in the Surficial Aquifer are intermediate layers of less permeable clays which are 300 or more feet thick.

A typical injection well will be about sixty inches in diameter at the top going down to about 24 inches in diameter at the bottom. The injection wells operate at very low pressure normally around 20 PSI. The injection wells are used to dispose of run-off water that should not be released into the streams, but is not heavily polluted water that might be found in an oil field environment.

The upper part of the injection well is the largest diameter and typically would have casing of approximately 54 inches in diameter cemented into place for approximately 100 feet in what is commonly known as "snubbing in." After snubbing in, a slightly smaller diameter hole and a smaller diameter casing will be set as the injection well is being drilled. Each time a string of casing is installed and cemented into place, a pilot hole of typically 12 inches in diameter is drilled a few hundred feet past the expected length of the next string of casing. The pilot hole is for testing using both geophysical logging tools and inflatable packers to determine the best depth for the next string of casing or completion of the well. Typically, there would be three to five sets of subsequently smaller hole sizes being drilled, each drilled inside of one another and each cemented with a different diameter casing.

Because the pilot hole has a much smaller diameter than hole in which the pilot hole is being drilled, a ledge is formed at the top of the pilot hole. Many times logging tools, inflatable packers, or other devices being lowered into the pilot hole will become stuck on the ledge.

Throughout the drilling process, typically a temporary drilling header, sometimes referred to as a "rotating control device," is used at the surface to control or prevent artesian flow out of the well. The temporary drilling header includes stripping rubber that seals around the drill pipe while allowing a drill pipe to move up and down. The stripping rubber removes material stuck to the drill pipe. The problem with this type of temporary drilling header is that the bits, weights, and/or drill collars are larger in diameter than the drill pipe. While the drill pipe can go through the temporary header, these larger diameter devices cannot.

In the past, when inserting or removing the larger diameter devices from the well being drilled, the temporary drilling header had to be removed. To remove the temporary drilling header, the well would have to be killed using a heavy drilling mud. The killing or suppressing of a well during the drilling process is time consuming and expensive. A heavy drilling mud would need to be mixed and injected into the well, which heavy drilling mud would then intermix with native well bore fluids. It may later be difficult to remove the heavy drilling mud from the native well bore fluids. Also, the possibility of loss of well control during well suppression or killing activities could occur. While salt and barite are the two most common materials used to create a heavy drilling mud to kill and/or suppress a well, other materials could also be used. In large artesian aquifer zones, it is common to use a truckload or more of salt or barite to mix into slurry each time a well is killed. During the typical construction of a large diameter injection well, the well is suppressed/killed approximately twenty times.

While drilling an injection well and setting the first two strings of casing, the well bore is filled with bentonite drilling fluid, commonly called "mud". The mud is pumped down through the drilling pipe and returns to the surface between the outside of the drilling pipe and the well bore. The mud will carry the cuttings suspended therein.

After the second string of casing is cemented, the mud is evacuated from the casing and replaced with water. From this point forward, drilling fluid (mud) is no longer used with the present invention. Water is forced to flow in the reverse direction, namely, down the outer annulus and back up the drilling pipe with the water carrying the cuttings to the surface.

SUMMARY OF THE INVENTION

It is an object of the present invention to control artesian flow while drilling an injection well without using a weighted drilling fluid.

It is another object of the present invention to reduce the number of times a large diameter water well must be killed or suppressed during drilling.

It is still another object of the present invention to insert drillable centering guides in the lower most casing before drilling a pilot hole in the bottom of the well being drilled. The drillable center guide being drilled out when the next segment of the well is drilled for a reduced diameter casing.

It is yet another object of the present invention to have a temporary drilling header at the top of a large diameter disposal well during the drilling process, which temporary drilling header is installed after the disposal well is snubbed in. A second casing is set down to approximately 1000 feet in depth. After installing the temporary drilling header, a drop pipe is installed that extends below the temporary drilling header. The drop pipe is connected to the temporary drilling header by any convenience means, such as bolted to flanges or a welded connection to the previously installed casing. Above the temporary drilling header on the drill pipe is connected a rotating control device with stripper rubber for cleaning the drill pipe as it goes in or out of the well. Connected to a lower end of the drop pipe is a valve operated by a hydraulic cylinder to open or close the lower end of the drop pipe. By the use of the drop pipe, access to the inside of the disposal well being drilled can be obtained without killing or suppressing the well.

In the past, if the temporary drilling header had to be removed to set drill collars, replace drill bits, do geophysical logging or anything else requiring larger diameter items pass through temporary drilling header to access lower regions of the disposal well, the disposal well would have to be killed or suppressed by using heavy drilling fluid to stop any artesian flow. By use of a drop pipe with a hydraulically actuated lower valve, it is not necessary to kill the well when moving larger diameter items through the temporary well header via the drop pipe.

A bottom hole assembly can be lowered through the temporary well header into the drop pipe when the valve on the lower end of the drop pipe is closed. Thereafter, the rotating control device and a stripper rubber is secured against the drill pipe so that when the lower valve is open, there will not be any artesian flow from the well being drilled.

In the drilling of a disposal well, pilot holes are drilled beyond the lower end of the casing, which pilot holes are used for geophysical logging tools and inflatable packers. Also, if samples need to be obtained, they can be obtained by having a bottom hole assembly connecting through the temporary drilling header into the drop pipe while the lower valve of the drop pipe is closed. Thereafter, once the rotating control device and stripper rubber are in place, the lower valve on the drop pipe can be opened and the bottom hole assembly lowered to collect samples. This typically occurs several times for each disposal well. By use of the drop pipe and the hydraulically operated valve, this can be done repeatedly without having to kill or suppress the well. The length of the drop pipe is determined by the bottom hole assembly that is to be used in drilling the injection well. Typically the drop pipe that would be two to three hundred feet in length. By using the drop pipe, large amounts of heavy fluid to suppress or kill the artesian flow from the well is no longer necessary.

BRIEF DESCRIPTION OF THE DRAWINGS

FIG. 7 is a lower cross-sectional view of a pilot hole being drilled in a large diameter injection water well.

FIG. 8 is a lower cross-sectional view of geophysical logging tools being inserted in a pilot hole in a large diameter injection water well.

FIG. 9 is an enlarged cross-sectional view of a drillable centering guide.

DESCRIPTION OF THE PREFERRED EMBODIMENT

Figure 1:
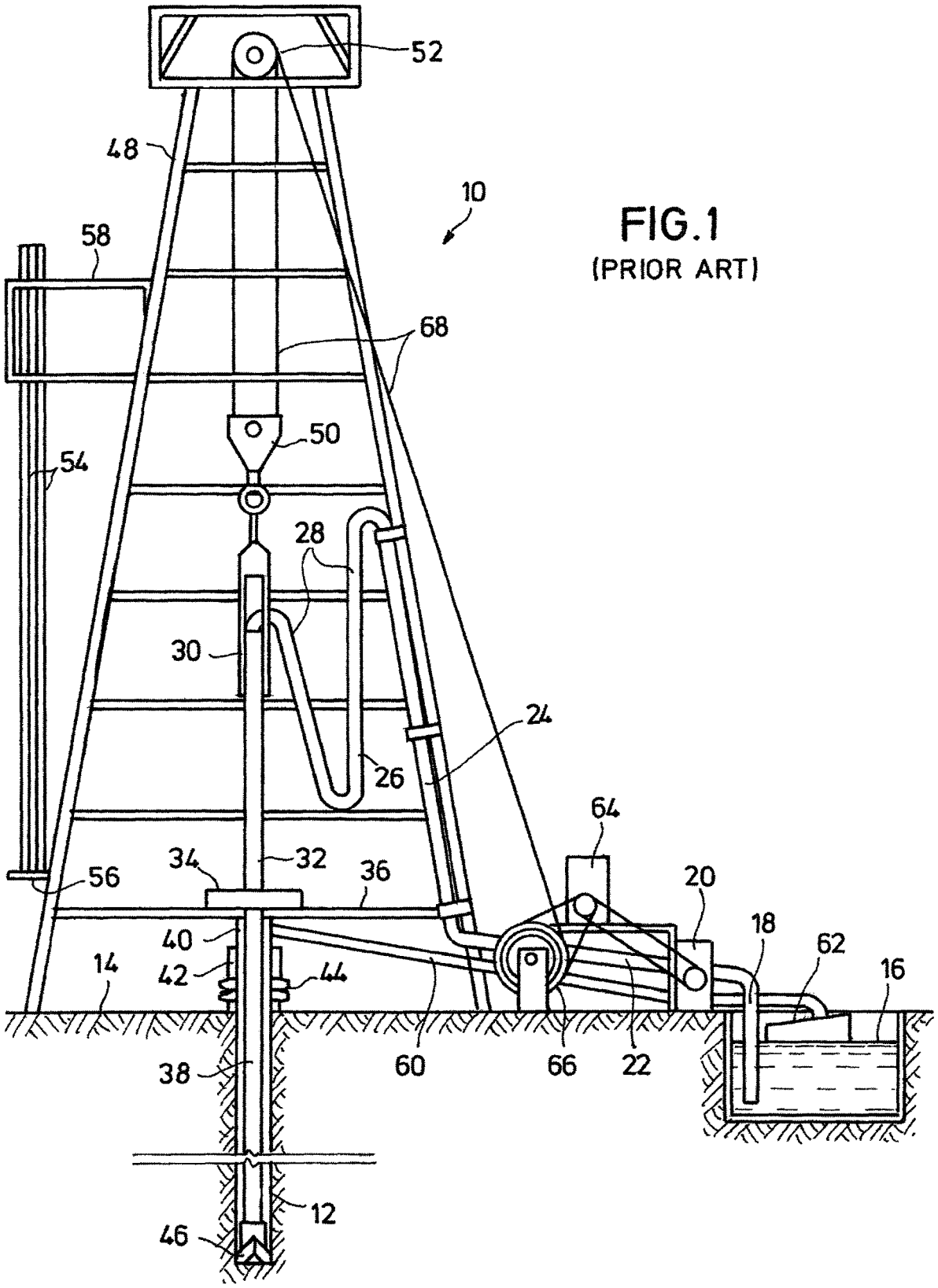
FIG.1 (PRIOR ART)
FIG. 1 is a pictorial illustration of a prior art oil drilling rig.

Before explaining the present invention, an explanation as to how an oil well is drilled is helpful. Referring to FIG. 1, a simplified pictorial representation of an oil field derrick 10 drilling an oil well 12 in the earth's surface 14 is shown. A mud tank 16 holds a drilling mud, such as barite, which may be delivered via a suction line 18 to mud pump 20, through vibrating hose 22, standpipe 24, kelly hose 26, goose necks 28, swivel 30 to Kelly drive 32. From the Kelly drive 32, the drilling mud travels through the rotary table 34 and drilling floor 36 to the drill string 38. However, before reaching the drill string 38, the drilling mud must travel through bell nipple 40, an angular blowout preventer 42, and ram blow-out preventers 44.

While FIG. 1 shows a rotary table 34, a tophead rotary drive may be used. Either one uses rotary drive to turn the drill string 38.

As the rotary table 34 turns the drill string 38 drilling mud from the mud tanks 16 is delivered under pressure through drilling string 38 to the drill bit 46. As the oil well 12 is drilled deeper, derrick 48 uses traveling block 50 and crown block 52 to add additional drill pipes from the stand 54 of drill pipes, which stand 54 holds the pipe rack 56 by monkey board 58. As additional pipe is added to the drill string 38, flow of the mud from the mud tank 16 is stopped. The weight of the drilling mud will keep pressures inside the oil well 12 from blowing out the top of the oil well 12. Blow out preventers 42 and 44 also ensure that pressures inside of the oil well 12 will not escape.

Mud from the mud tank 16 flows into the oil well 12 by flowing downward through the drill string 38. The mud returns in the annulus formed between the drill string 38 and the well 12 being drilled in the earth simultaneously carrying any cuttings to the surface. The returning mud and cuttings flows through flow line 60 to a shell shaker 62 for removal of cuttings before returning the mud to the mud tank 16.

Motor 64 with draw works 66 operate drill lines 68 to move traveling block 50 and rotate crown block 52 when adding more pipe from stand 54 to the drill string 38. This is a simplified description of how an oil well is drilled using standard techniques.

Figure 3:
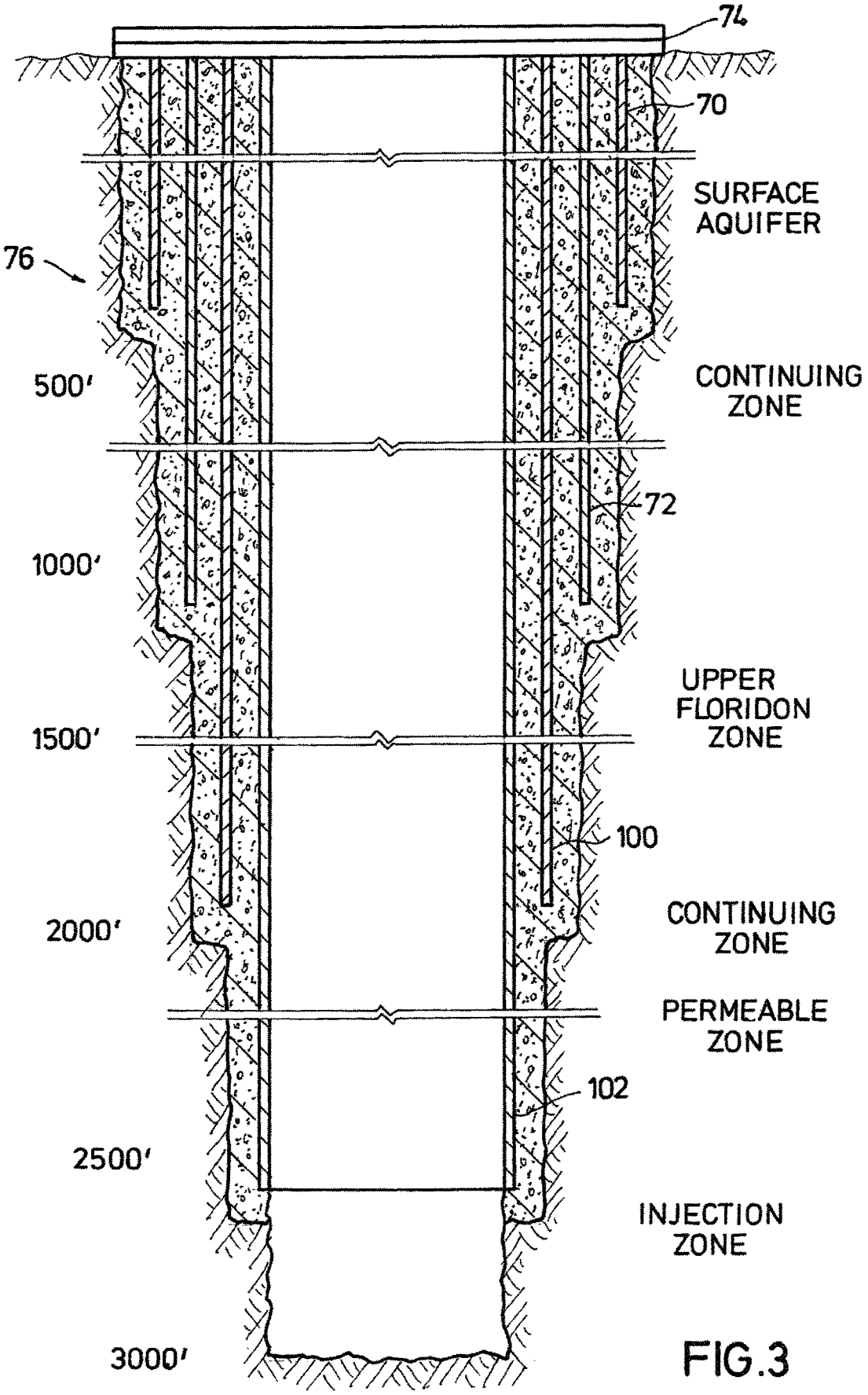
FIG. 3 is an illustrative sectional view of the underground portion of a large diameter injection water well.

In the drilling of the large diameter disposal water wells, similar techniques are used during the drilling process. A large diameter disposal water well that might be drilled in central or southern Florida would typically be snubbed in with a 54 inch steel casing 70. See FIG. 3. After the 54 inch steel casing 70 is cemented into place, mud will continue to flow through the drill string 38. See FIG. 1.

Because a large diameter disposal water well is being drilled, a pilot hole should first be drilled below each string of reduced diameter casings that are to be installed. Referring to FIG. 7, a large diameter drillable centering guide 104 is installed in the last 50 feet of the 54 inch steel casing 70. The large diameter drillable centering guide 104 centers the drill string 38 in the bottom 106 of the well 76. In that manner, the drill bit 46 will center within the remnant cement 108 collected in the bottom 108 of the well 76 when cementing the 54 inch steel casing 70 into position during snubbing in. With the use of the large diameter drillable centering guide 104, drill bit 46 on the end of drill string 38 can then drill a pilot hole 110 that will be centered in the bottom 106 of 54 inch steel casing 70. See FIG. 8.

In a typical large diameter water well, the pilot hole 110 will be drilled to approximately 1000 feet in depth. Because the large diameter drillable centering guide 104 is attached toward the bottom of casing 70, the well 76 will be drilled in the bottom center thereof by drill bit 46 attached to the lower end of drill string 38.

After installing large diameter drillable centering guide 104 and the drilling of the pilot hole 110, geophysical logging tools 112 can be attached to the lower end of logging cable 114. By extending or retracting the logging cable 114, the geophysical logging tools 112 will be raised or lowered in the pilot hole 110. In this matter, the entire depth of the pilot hole 110 can be logged from the surface. The logging will tell the operator where different zones or different zone conditions are located, which in turn tells the operator if packers are needed to separate the different subsurface zones.

An enlarged cross-sectional view of the large diameter drillable centering guide 104 is shown in FIG. 9. The large diameter drillable centering guide 104 has a wear ring 116 on the center thereof and a steel casing 118 that will just fit in steel casing 70. Fill between the wear ring 116 and the 54 inch steel casing 118 is cement 120 that has rope reinforcement 122 therein. Wear ring cement retainment devices 124 extend outward from the wear rings 116. Casing cement retainment devices 126 extend inward from steel casing 118. The wear ring cement retaining device 124 and casing cement device 126 hold the cement 120 and rope reinforcement 122 in position. A funnel shaped surface 128 forms the upper surface of the large diameter drillable centering guide 104. The funnel shaped surface 128 directs items such as the drill sting 38 and drill bit 46 to the center of the well 76. As shown in FIG. 7. Also, funnel shaped surface 128 of the large diameter drillable centering guide 104 directs geophysical logging tools 112 being lowered by logging cable 114 into the pilot hole 110. This prevents the geophysical logging tool 112 from getting stuck on ledges 130 formed in the bottom 106 while being lowered into pilot hole 110.

Subsequently, a 44 inch steel casing 72 will have to be installed and cemented into place down to approximately 1000 feet in depth. Through the cementing in place of the 44 inch steel casing 72, drilling mud may be used, which drilling mud is pumped down through a drill string 38 and up through the outer annulus back to the surface. Everything through this point is the same as the prior art except there are larger diameters and lower pressures.

Prior to the setting of the 44 inch steel casing 72, the pilot hole 110 will have to be drilled out to approximately 1000 feet. When enlarging the pilot hole 110 to receive the next size steel casing 72 (which is 44 inches in diameter), the large diameter drillable casing guide 104 will have to be drilled out. This can be accomplished by simply having a drill bit that drills out a hole with a diameter enough to receive the 44 inch steel casing 72 therein.

Figure 2:
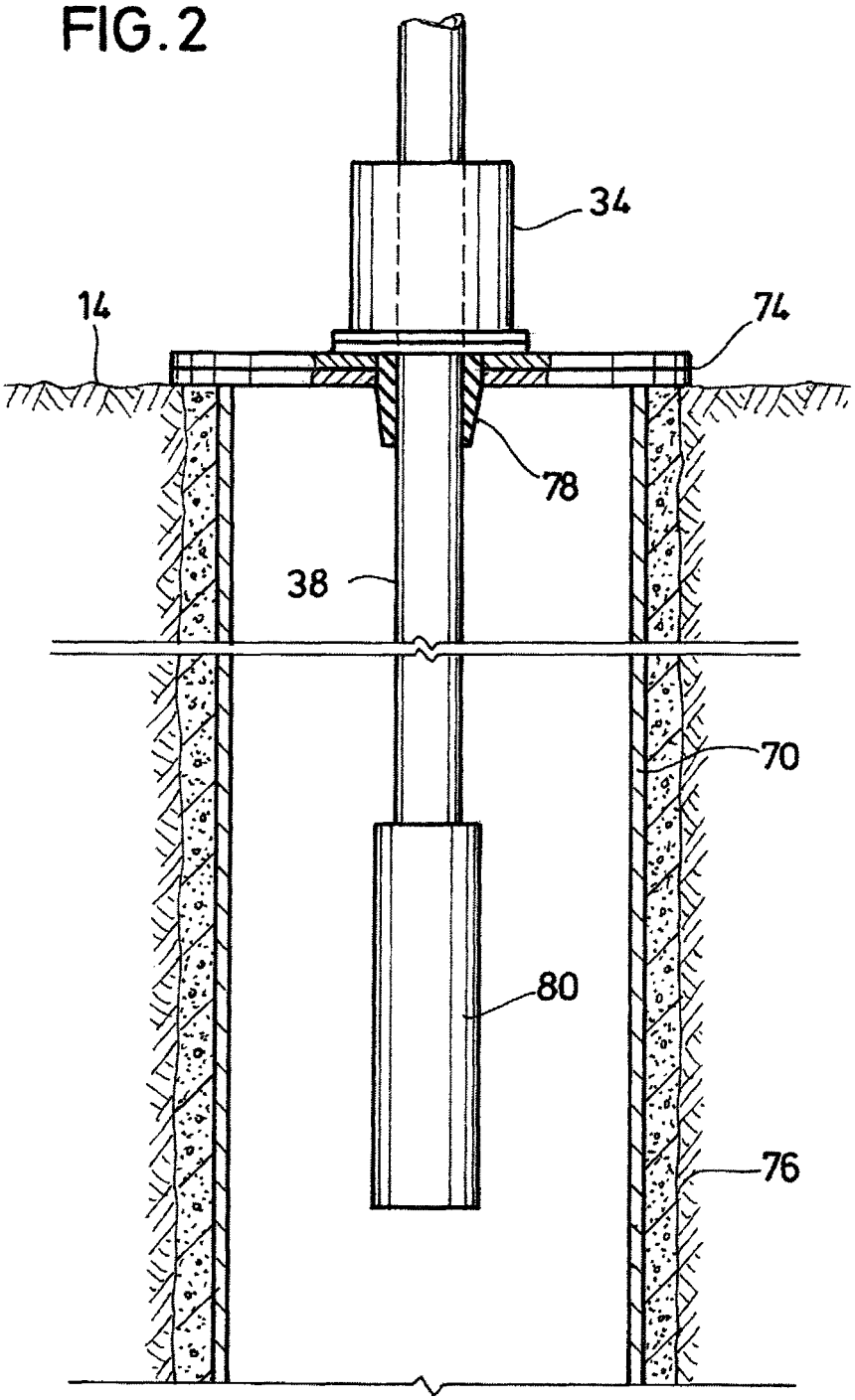
FIG. 2 is a simplified, partial, cross-sectional view of the upper portion of a large diameter injection water well being drilled.

Upon setting the 44" steel casing 72 into place the drilling mud is removed and a temporary drilling header 74 is installed. See FIG. 2. The temporary drilling header 74 is located below the blowout preventers 42 and 44. See FIG. 1. The next step in drilling the disposal water well is to drill a pilot hole approximately twelve inches in diameter to approximately two-thousand feet. The temporary drilling header 74 is normally installed after the drilling of the pilot hole. Typically, three or four core samples will be needed when drilling from 1000-2000 feet in depth. This requires tripping the drill string 38 out of the well 76. To prevent artesian flow therefrom, the well 76 will have to be either suppressed or killed. As the drill string 38 is removed from the well 76 as shown in FIG. 2, stripper rubber 78 will remove material from the drill string 38.

On the bottom of the drill string 38 is located bottom hole assembly 80. The bottom hole assembly 80 may be a drill bit, packer, coring bell, a logging device, etc. However, the bottom hole assembly 80 normally cannot get past the rubber stripper 78 and/or temporary drilling header 74 nor past the rotary table 34. In the past, each time the bottom hole assembly 80 has to come out of the well 76, pressures inside the well 76 have to be either killed or suppressed. Previously, to kill or suppress pressures inside of the well 76 required a large amount of barite or salt to mix into a drilling mud. It is expensive and time consuming to have to kill or suppress the well using large amount of salt or barite. When drilling operations are to be resumed, the drilling mud or slurry will need to be reduced and/or removed from the well 76. The weight of the slurry/drilling mud prevents artesian flow from well 76.

Figure 4:
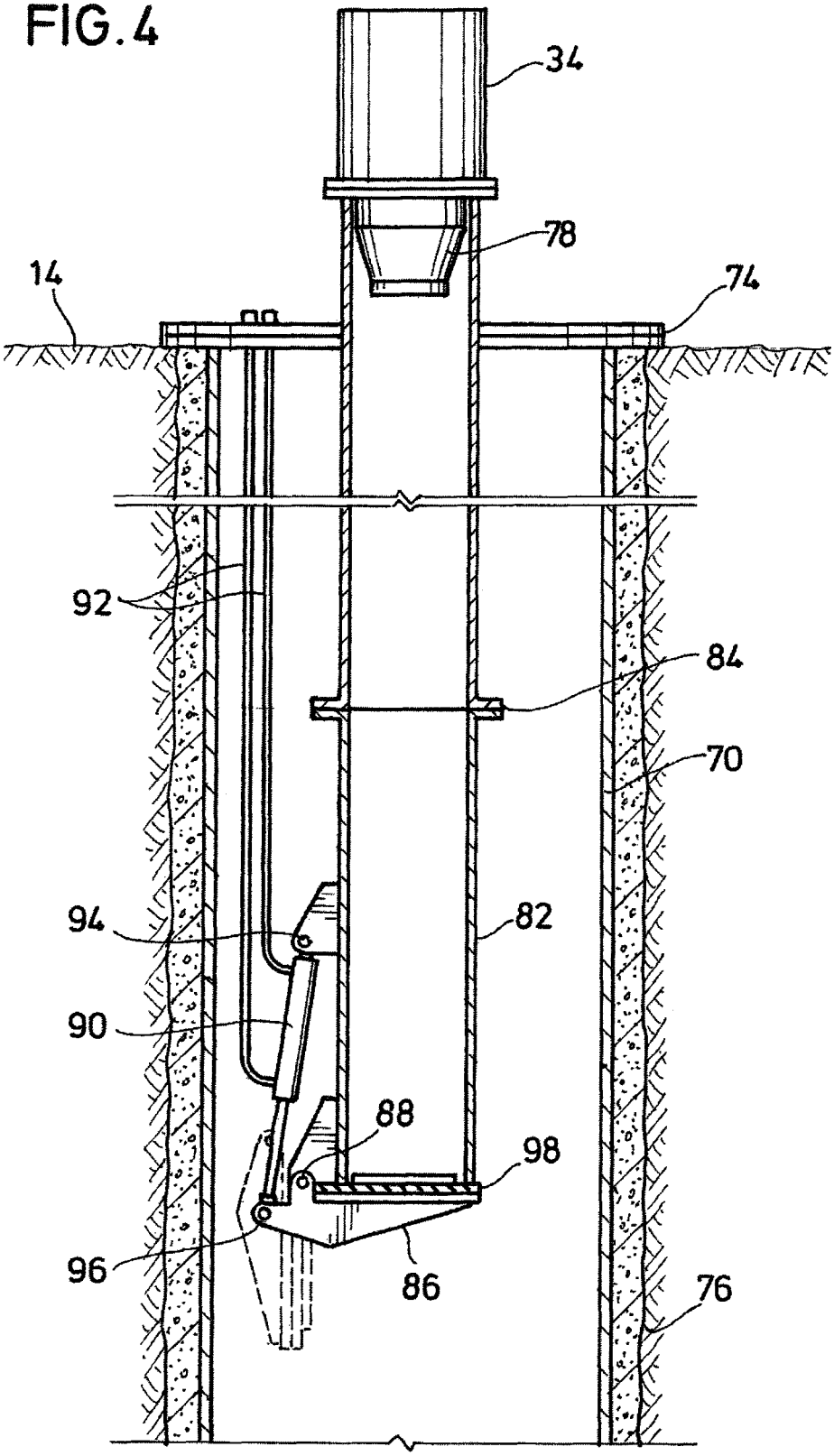
FIG. 4 is a partial, cross-sectional view of the upper portion of a large diameter injection water well with a hydraulically actuated valve opening or closing a lower end of a drop pipe.

To prevent having to repeatedly kill the well 76, the temporary drilling header 74 has been modified so that a drop pipe 82 extends downward from the temporary drilling header 74. See FIG. 4. While the length of the drop pipe 82 may vary, it is estimated that drop pipe would be approximately two hundred feet in length. The drop pipe 82 is attached at the upper end to temporary drilling header 74. Flanges 84 are welded, or threaded connections may be used to add the necessary length to the drop pipe.

On the lower end of the drop pipe 82 is located a valve 86 that is pivotally mounted on pivot pin 88. The operation of the hydraulic cylinder 90 causes valve 86 to be opened or closed. Hydraulic fluid for the hydraulic cylinder 90 is provided through hydraulic hoses 92. Each end of the hydraulic cylinder 90 is free to pivot on pivot pins 94 and 96. If the valve 86 is closed, a rubber sealing element 98 prevents leakage through the drop pipe 82.

Figure 5:
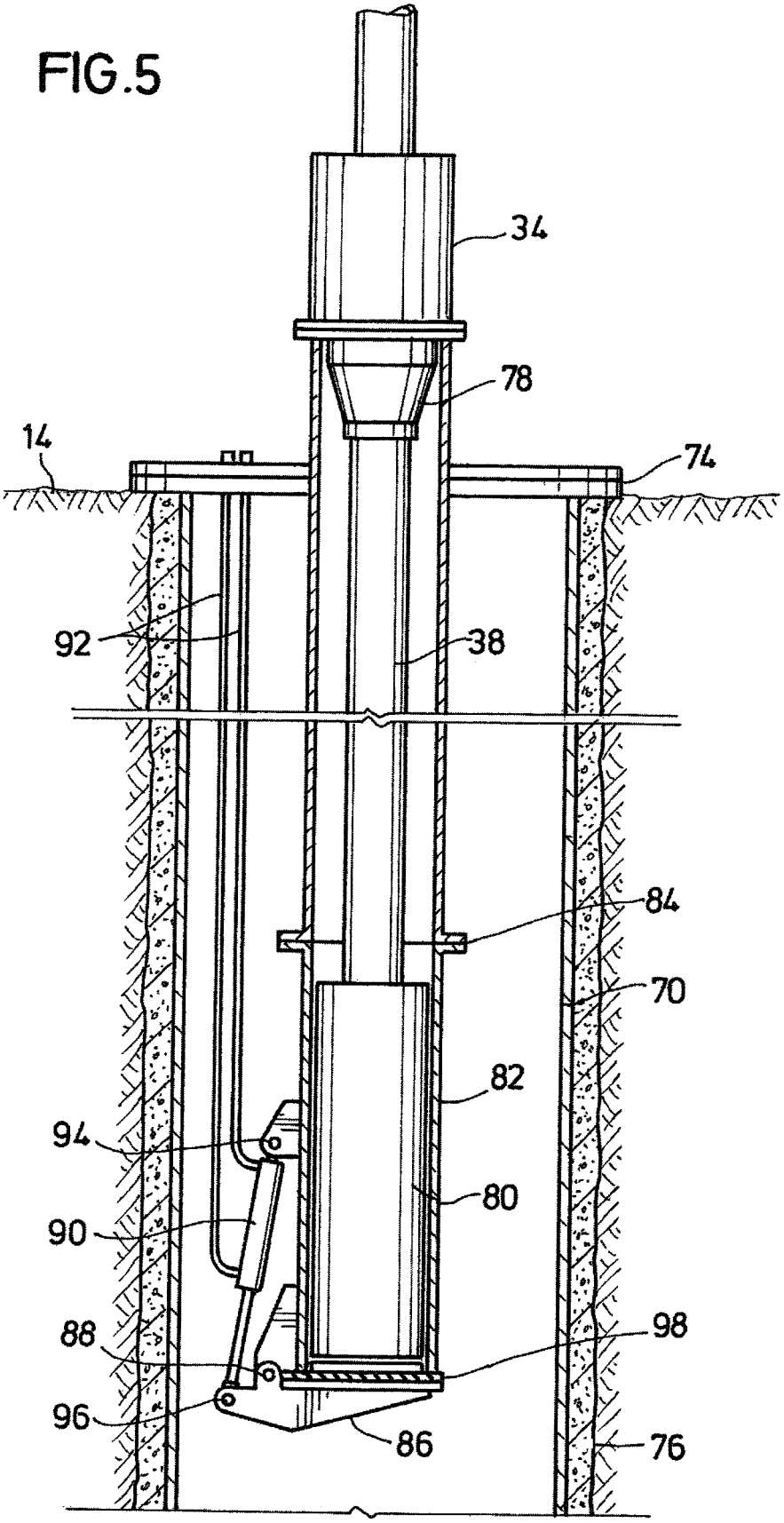
FIG. 5 is a partial, cross-sectional view of the upper portion of a large diameter injection water well having a drop pipe with a bottom hole assembly therein prior to opening a lower valve.
Figure 6:
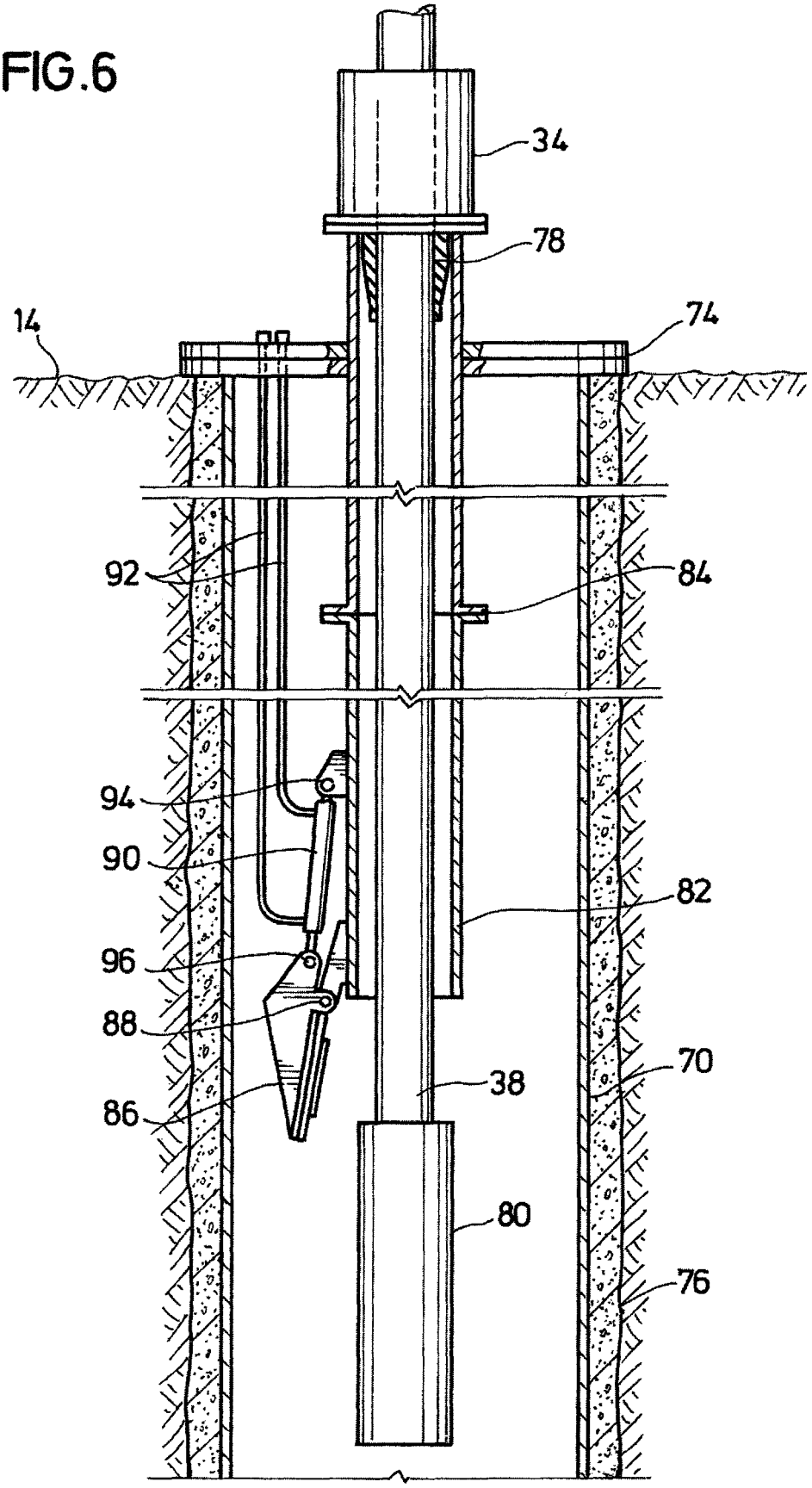
FIG. 6 is a partial, cross-section of the upper portion of a large diameter injection water well with a bottom hole assembly extending through a drop pipe and a lower valve into lower portions of the large diameter injection water well.

Referring to FIGS. 5 and 6 in combination, the present invention will be illustrated in further detail. In FIG. 5 the well 76 is being drilled into the earth 14. The initial steel casing 70 has been snubbed in into position and cemented in place. The 44" steel casing 72 (See FIG. 3) may, or may not, need suppression while it is being installed. A temporary drilling header 74 is installed at the top of the steel casing 70. The drop pipe 82 extends downward from the temporary drilling header 74. In the FIG. 5 hydraulic cylinder 90 has closed the valve 86 located at the bottom of the drop pipe 82. With the valve of 86 closed, drill pipe 38 along with bottom hole assembly 80 are lowered into the drop pipe 82. The upper part of the drill pipe 38 is sealed with the stripper rubber 78 and turned by rotary table 34.

Pressure inside of the well 76 does not need to be suppressed or killed when inserting drill string 38 and bottom hole assembly 80 because valve 86 is closed with rubber sealing 98 preventing leakage there through. After the bottom hole assembly 80 is inside of drop pipe 82, then stripper rubber 78 and rotary table 34 are secured to the drill string 38. By opening the valve 86 with the hydraulic cylinder 90, the drill string 38 and the bottom hole assembly 80 can be lowered to the bottom of well 76. The bottom hole assembly 80 can include a drill bit for drilling the hole deeper or a drill collar. The bottom hole assembly 80 can include coring equipment to get core samples. For injection water wells in Florida, it is important to run logging tools into the pilot holes.

With the use of the drop pipe 82 just as described in FIGS. 5 and 6, numerous trips can be made into the well 76 without having to kill or suppress the well. Pilot holes can be drilled and logged. Smaller 34" steel casing 100, and 24" steel casing 102 can be installed and cemented in place using tremie tubing (not shown). It is only necessary to kill or suppress the well 76 one time; namely, when the drop pipe 82 is being removed at the final completion of the well 76.

When a string of casing of a particular diameter has been set, that is when the large diameter drillable centering guide 104 is attached to the lower end of a drilling casing that is being set. For example, after the 54 inch steel casing 70 has been set and a pilot hole 110 drilled, thereafter the pilot hole 110 will have to be enlarged to receive the next size, i.e., the 44 inch steel casing 72. At the bottom of the 44 inch steel casing 72, a second large diameter drillable centering guide 104 will be installed to make sure the pilot hole being drilled between approximately 1000 feet to 2000 feet is drilled in the center thereof. As the well 76 is drilled, the casing is reduced in diameter. See FIG. 3. In this case, the large diameter drillable centering guide 104 has a smaller diameter so that it can be attached by bonding or otherwise to the lower end of a 44 inch steel casing 72.

On each occasion, before setting a new large diameter drillable centering guide 44, the preceding centering guide 104 of a larger diameter is drilled out. The procedure of drilling out the larger diameter of the large diameter drillable centering guide 104 before placing the next centering guide of a slightly smaller diameter is repeated when installing the 34 inch steel casing 100 and the 24 inch steel casing 102. On each occasion, the large diameter drillable center guide 104 makes sure the pilot hole 110 is being drilled in the center of the bottom 106. In this manner, the pilot hole 110 insures a well is being drilled that can accommodate geophysical logging tools or other items that may need to be lowered into the pilot holes 110. Also, the centering guide 104 makes sure the geophysical logging tool or other items being lower into pilot hole 110 do not become stuck on ledge 130.

We claim:

1. A method for drilling pilot holes while drilling a large diameter injection well through different underground zones using a drilling derrick having a rotary drive, drill pipe, drill bits, geophysical logging devices, blowout preventers, drilling mud, packers, and a source of power, said method including the following steps:

(a) first drilling a first large diameter hole using said drilling derrick, rotary drive, drill pipe, and drill bits;

(b) first setting a first diameter casing in said first large diameter hole;

(c) first securing a first drillable centering guide inside said first diameter casing near a bottom thereof, said first drillable centering guide having a first funnel-shaped upper surface terminating into a first centering hole therein;

(d) first pilot hole being drilled through said first centering hole;

(e) first logging in said first pilot hole using said geophysical logging devices;

(f) first separating said different underground zones in said first pilot hole with said packers;

(g) second drilling of a second large diameter hole through said first diameter casing, said second large diameter hole being smaller in diameter than said first diameter casing, said first drillable centering guide being drilled out during said second drilling;

(h) second setting a second diameter casing in said second large diameter hole;

(i) second securing a second drillable centering guide inside said second diameter casing near the bottom thereof, said second drillable centering guide having a second funnel shaped upper surface terminating into a second centering hole therein;

second pilot hole drilled through said second centering hole;

(k) second logging in said second pilot hole using said geophysical logging device; and (l) second separating said different underground zones in said second pilot hole with said packers.

2. The method of drilling pilot holes while drilling a large diameter injection well as recited in claim 1 further comprising after step (l) repeating steps (a) through (f) while setting a third diameter casing, which is smaller in diameter than said second diameter casing.

3. The method of drilling pilot holes while drilling a large diameter injection well as recited in claim 2 further comprising after the last step in claim 2 repeating a second time steps (a) through (f) while setting a fourth diameter casing, which is smaller in diameter than said third diameter casing.

4. The method of drilling pilot holes while drilling a large diameter injection well as recited in claim 1, said method including the following step:

third drilling of a third large diameter hole through said second diameter casing, said third large diameter hole being smaller in diameter than said second diameter casing, said second drillable centering guide being drilled out during said third drilling;

third setting a third diameter casing in said third large diameter hole;

third securing a third drillable centering guide inside said third diameter casing near the bottom thereof, said third drillable centering guide being a third funnel shaped upper surface terminating into a third centering hole therein;

third pilot hole drilled through said third centering hole;

third logging in said third pilot hole using said geophysical logging device; and third separating said different underground zones in said third pilot hole with said packers.

5. The method of drilling pilot holes while drilling a large diameter injection well as recited in claim 4, said method including the following steps:

fourth drilling of a fourth large diameter hole through said third diameter casing, said fourth large diameter hole being smaller in diameter than said third diameter casing, said third drillable centering guide being drilled out during said fourth drilling;

fourth setting a fourth diameter casing in said fourth large diameter hole;

fourth securing a fourth drillable centering guide inside said fourth diameter casing near the bottom thereof, said fourth drillable centering guide having a fourth funnel shaped upper surface terminating into a fourth centering hole therein;

fourth pilot hole drilled through said fourth centering hole; and fourth logging in said fourth pilot hole using said geophysical logging device.

6. An apparatus for drilling a large diameter injection well through different underground zones including a drilling derrick;

a rotary drive on said drilling derrick;

a pipe stand on said drilling derrick for holding drilling pipes;

a crown block and a traveling block in said drilling derrick for raising or lowering individually said drilling pipes through said rotary drive into said large diameter injection well during drilling;

a mud pump for pumping drilling mud from a mud tank and down said drilling pipes into said large diameter injection well;

bell nipple below said rotary drive for returning drilling mud to a shaker for removing cuttings before returning said drilling mud to said mud tank;

blowout preventers located below said bell nipple and surrounding said drilling pipe;

a large diameter casing being snubbed in at a top of said large diameter injection well;

an improvement comprising:

drillable centering guides installed near a bottom of said large diameter casing;

a temporary drilling header being installed below said blowout preventer;

drop pipe sealed at a top thereof to said temporary drilling header and extending downward into said large diameter casing, bottom of said drop pipe being open;

valve mounted on said drop pipe to open or close said bottom of said drop pipe; and actuator on said drop pipe to open or close a flapper of said valve, said flapper opening or closing said drop pipe.

7. The apparatus for drilling a large diameter injection well as recited in claim 6 wherein said drillable centering guides have a conical shaped upper surface with a centering hole in the bottom center thereof, said drillable centering guide directs drilling pipe to a center of said large diameter injection well when drilling a pilot hole therein.

8. The apparatus for drilling a large diameter injection well as recited in claim 7 wherein said actuator is a hydraulic cylinder with pressurized fluid being supplied outside said drop pipe from said drilling derrick to operate said flapper of said valve.

* * * * *